US008938182B2

(12) United States Patent
Lee et al.

(10) Patent No.: US 8,938,182 B2
(45) Date of Patent: Jan. 20, 2015

(54) STAND OF IMAGE FORMING APPARATUS AND IMAGE FORMING APPARATUS HAVING THE SAME

(75) Inventors: Yong-hyun Lee, Suwon-si (KR); Jong-cheon Hong, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 680 days.

(21) Appl. No.: 12/497,815

(22) Filed: Jul. 6, 2009

(65) Prior Publication Data

US 2010/0014886 A1 Jan. 21, 2010

(30) Foreign Application Priority Data

Jul. 18, 2008 (KR) ..... 10-2008-0070217

(51) Int. Cl.
*G03G 15/00* (2006.01)
*G03G 21/16* (2006.01)

(52) U.S. Cl.
CPC ..... *G03G 21/1619* (2013.01); *G03G 21/16* (2013.01); *G03G 2215/00012* (2013.01); *G03G 2221/1678* (2013.01)
USPC ..... 399/107; 248/188.5; 248/419; 312/351.2

(58) Field of Classification Search
CPC ..... G03G 21/1609; G03G 21/1619; G03G 2215/00012; G03G 2221/1678
USPC ..... 399/110, 124; 312/223.1, 351.1; 248/176.3, 188.5
See application file for complete search history.

(56) References Cited

U.S. PATENT DOCUMENTS

| | | | | |
|---|---|---|---|---|
| 2,739,776 | A * | 3/1956 | Terando | 108/54.1 |
| 5,080,320 | A * | 1/1992 | Chieng | 248/670 |
| 2002/0098008 | A1 * | 7/2002 | Tashiro et al. | 399/107 |
| 2004/0079855 | A1 * | 4/2004 | Strabel, III | 248/650 |
| 2004/0247338 | A1 * | 12/2004 | Makino | 399/107 |
| 2006/0188304 | A1 * | 8/2006 | Yamazaki et al. | 399/384 |

FOREIGN PATENT DOCUMENTS

JP 2000-044111 A * 2/2000 ..... B65H 37/04

OTHER PUBLICATIONS

Korean Office Action dated Sep. 18, 2012 issued in KR Application No. 10-2008-0070217.
Office Action issued in KR Application No. 10-2008-0070217 dated Mar. 29, 2013.

* cited by examiner

*Primary Examiner* — Benjamin Schmitt
(74) *Attorney, Agent, or Firm* — Staas & Halsey LLP

(57) ABSTRACT

A stand of the image forming apparatus includes at least one plate unit including a first plate member which includes a first surface unit which forms an external appearance and a first bent unit which is provided to at least one of the opposite end parts of the first surface unit, and a second plate member which includes a second surface unit and a second bent unit which is provided to at least one of the opposite end parts of the second surface unit, and is capable of being inserted into the first plate member, at least one of the first bent unit and the second bent unit being bent so that each bending direction thereof may start from at least one of the first surface unit and the second surface unit, and then bend toward at least one of the first surface unit and the second surface.

25 Claims, 17 Drawing Sheets

STAND OF IMAGE FORMING APPARATUS AND IMAGE FORMING APPARATUS HAVING THE SAME

CROSS-REFERENCE TO RELATED APPLICATIONS

This application claims priority under 35 U.S.C. §119(a) from Korean Patent Application No. 10-2008-0070217, filed on Jul. 18, 2008 in the Korean Intellectual Property Office, the disclosure of which is incorporated herein by reference.

BACKGROUND OF THE INVENTION

1. Field of the Invention

The present general inventive concept relates to a stand of an image forming apparatus and an image forming apparatus having the same, and more particularly, to a stand of an image forming apparatus and an image forming apparatus having the same that reduces a manufacturing cost.

2. Description of the Related Art

An image forming apparatus includes a printing engine to form an image on a printing medium, and a stand to support the printing engine.

However, the size of the printing engine varies according to the type of the image forming apparatus, and the size of the stand varies to correspond thereto. Accordingly, since the type of the stand may be as varied as the number of models of the printing engine, the manufacturing cost thereof may increase.

The printing engine seated on the stand may weigh more than 100 kg, and it is important that the stand has a configuration which is capable of stably supporting the weight.

Also, since the stand itself has a significant size, it is inconvenient to transport the stand to an installation site.

SUMMARY OF THE INVENTION

The present general inventive concept provides a stand of an image forming apparatus and an image forming apparatus having the same, which can reduce the manufacturing cost thereof.

The present general inventive concept also provides a stand of an image forming apparatus and an image forming apparatus having the same which is capable of stably supporting a printing engine.

The present general inventive concept also provides a stand of an image forming apparatus and an image forming apparatus having the same which is capable of being conveniently transported to an installation site.

Additionally, the present general inventive concept provides a stand of an image forming apparatus and an image forming apparatus having the same which is capable of being conveniently assembled and disassembled.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a stand of an image forming apparatus, including a first plate member which includes a first surface unit which forms an external appearance, and a first bent unit which is provided to at least one of the opposite end parts of the first surface unit, and at least one plate unit which includes a second plate member which includes a second surface unit and a second bent unit which is provided to at least one of the opposite end parts of the second surface unit, the second plate member capable of being inserted into the first plate member, and at least one of the first bent unit and the second bent unit being bent so that each bending direction thereof may start from at least one of the first surface unit and the second surface unit and bend toward at least one of the first surface unit and the second surface unit.

The second bent unit may be capable of being inserted into an inner part of the first bent unit.

At least one pair of the first surface unit and the first bent unit and the second surface unit and the second bent unit may be integrally formed.

The first plate member may be slidingly movable in a lengthwise direction of the first bent unit or the second bent unit with respect to the second plate member.

The stand of the image forming apparatus may further include a position settling unit which settles a position of the second plate member in a position into which the second plate member slides with respect to the first plate member.

The position settling unit may include first and second thru holes which are respectively formed to the first bent unit and the second bent unit which face each other, and a coupling unit which is inserted to the first and second thru holes to couple the first bent unit and the second bent unit.

At least one of the first and second thru holes may be a plurality of thru holes provided in the lengthwise direction of the bent unit to permit adjustment of a relative position between the first plate member and the second plate member.

The at least one plate unit may further include a third plate member which includes a third surface unit which forms an external appearance, and a third bent unit which is bent from the third surface unit.

The second plate member may be interposed between the first plate member and the third plate member, and is capable of being inserted into the first plate member and the third plate member.

The third plate member may be provided to be compatible with the first plate member.

The third bent unit may be bent so that a bending direction thereof may start from the third surface unit, and bend toward the third surface unit.

The second bent unit may be capable of being inserted to an inner part of the first bent unit and the third bent unit.

The second plate member may be slidingly movable in a lengthwise direction of the first bent unit or the third bent unit with respect to at least one of the first plate member and the third plate member.

The stand of the image forming apparatus may further include a position settling unit which settles a position of the second plate member with respect to at least one of the first plate member and the third plate member.

The plate unit may include an upper plate unit and a lower plate unit which face a lower side of the image forming apparatus, and are disposed at a distance from each other, and a left plate unit and a right plate unit which connect the upper and lower plate units.

The upper and lower plate units may respectively include first and second plate members, and at least one of the first plate member and the second plate member may be slidingly movable to allow a width adjustment.

The left and right plate units may respectively include the first and second plate members, and at least one of the first plate member and the second plate member may be slidingly movable to allow a height adjustment.

The plate unit may include a lower plate unit which faces a lower part of the image forming apparatus.

The lower plate unit may include the first and second plate members, and at least one of the first plate member and the second plate member is slidingly movable to allow a width adjustment.

The foregoing and/or other features and utilities of the present general inventive concept may be achieved by providing an image forming apparatus, including a printing engine which forms an image on a printing medium and a stand to support the printing engine, which may include a first plate member which includes a first surface unit which forms an external appearance, and a first bent unit which is provided to at least one of the opposite end parts of the first surface unit, and at least one plate unit which includes a second plate member which includes a second surface unit and a second bent unit which is provided to at least one of the opposite end parts of the second surface unit, the second plate member capable of being inserted into the first plate member, and at least one of the first bent unit and the second bent unit being bent so that each bending direction thereof may start from at least one of the first surface unit and the second surface unit and bend toward at least one of the first surface unit and the second surface unit.

The foregoing and/or other features and utilities of the present general inventive concept may be achieved by providing a stand of an image forming apparatus, including a lower plate unit including a first plate member and a second plate member, the second plate member including a bent portion to receive the first plate member, and an upper plate unit connected to the lower plate unit to provide a support surface for the image forming apparatus.

The first plate member may have a bent portion which is received by the bent portion of the second plate member.

The upper plate member may further include a first upper plate member and a second upper plate member, the second upper plate member having a bent portion to receive the first upper plate member.

The stand may further include a side unit disposed between the lower plate unit and the upper plate unit including a first side unit member and a second side unit member, the second site unit member having a bent portion to receive the first side unit member.

At least one of the lower plate unit, the upper plate unit, and the side unit may include a position settling unit to permit a relative position of the first plate member and the second plate member, the first upper plate member and the second upper plate member, and the first side unit member and the second side unit member, respectively, to be fixed.

A surface of the bent portion of the second plate member may face a surface of the second plate member.

The second plate member may include a surface unit and a bent portion, wherein the bent portion is bent such that a surface of the bent portion faces a surface of the surface unit.

The second plate member may include a surface unit and a bent portion, wherein the bent portion is a predetermined distance from the surface unit to permit the first plate member to be received by the second plate member.

The foregoing and/or other features and utilities of the present general inventive concept may be achieved by providing a stand of an image forming apparatus, including a lower plate unit including a first lower plate member and a second lower plate member each comprising a plurality of bent portions such that the second lower plate member may slidingly accommodate the first lower plate member, and an upper plate unit to connect with the lower plate unit, including a first upper plate member and a second upper plate member each comprising a plurality of bent portions such that the second upper plate member may slidingly accommodate the first upper plate member.

The stand may further include a side unit, disposed in between the lower plate unit and the upper plate unit, including a first side member and a second side member each comprising a plurality of bent portions such that the second side member may slidingly accommodate the first side member.

The relative positions of at least the first lower plate member and the second lower plate member, and the first upper plate member and the second upper plate member, may be fixed with a position settling unit to determine a width of the stand.

The relative positions of the first side member and the second side member may be fixed with a position settling unit to determine a height of the stand.

BRIEF DESCRIPTION OF THE DRAWINGS

The present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
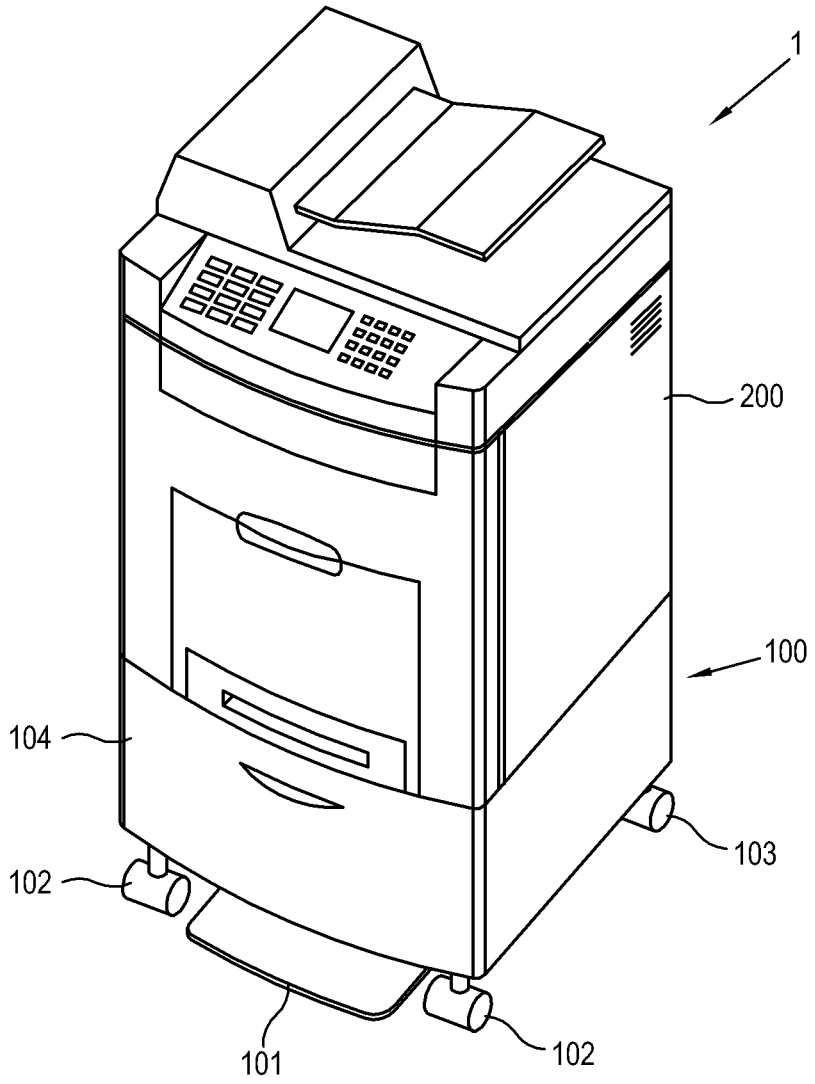
FIG. 1 illustrates a perspective view of an image forming apparatus according to a first exemplary embodiment of the present general inventive concept.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures. Repetitive description with respect to like elements of different embodiments may be omitted for the convenience of clarity.

As shown in FIG. 1, an image forming apparatus 1 according to an exemplary embodiment of the present general inventive concept includes a printing engine 200, and a knockdown stand of an image forming apparatus 100 supporting the printing engine 200.

The printing engine 200 may include a scanning unit (not shown) to scan an image of a document, and a printing unit (not shown) to print a scanned image on a printing medium.

The printing unit may print an image on a printing medium by at least one of a electrophotographic type, an ink jet type and a heat transferring type.

The knockdown stand 100 includes a pair of front rollers 102 and a pair of rear rollers 103 provided to a lower side thereof to easily move the image forming apparatus 1, a cover 104 openable at a front side, and a pair of overturn preventing plates 101 disposed between the front rollers 102 and the rear rollers 103 to prevent the image forming apparatus 1 from being overturned in a forward or backward direction.

A first end part of the overturn preventing plate 101 is connected to a lower part of the knockdown stand 100, and a second end part thereof extends toward a bottom surface on which the knockdown stand 100 is installed. The overturn preventing plate 101 is detachably disposed to the knockdown stand 100. In this exemplary embodiment, a part or all of the cover 104, the rollers 102 and 103 and the overturn preventing plate 101 may be omitted as necessary.

Figure 2:
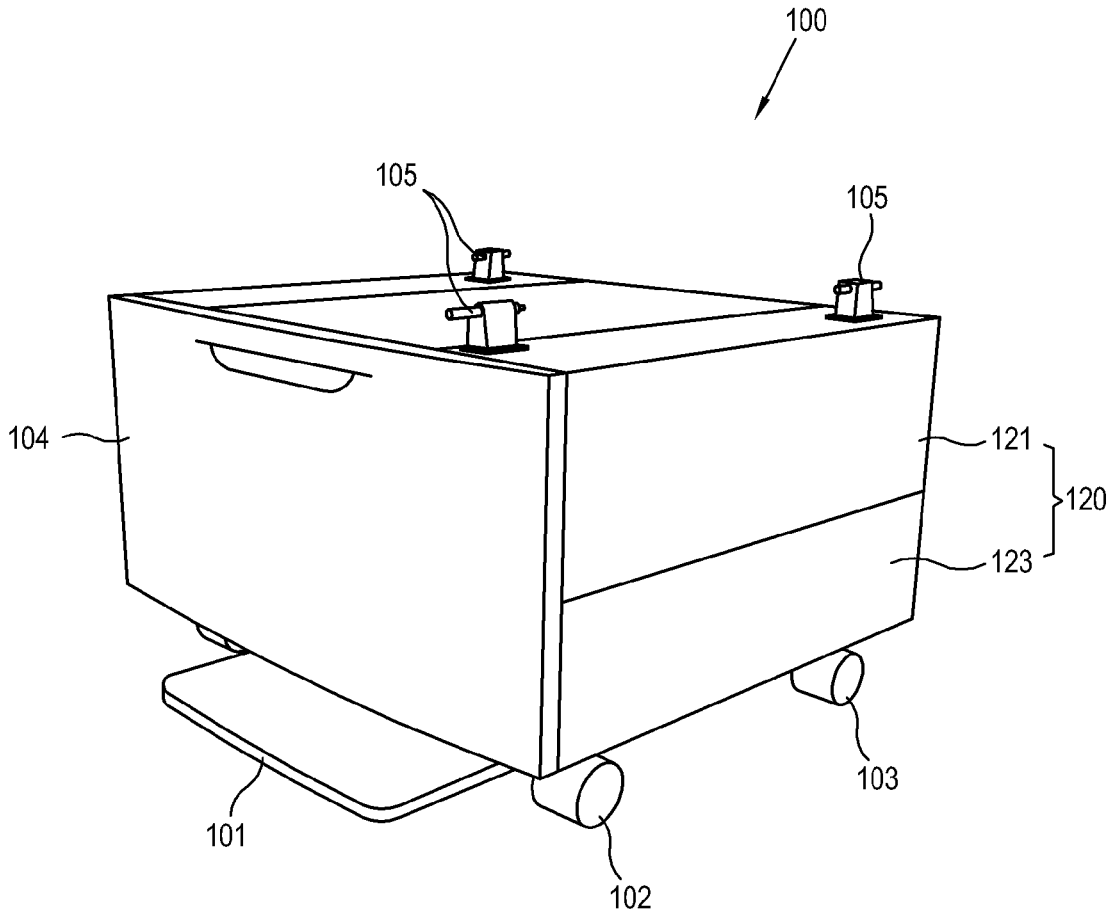
FIG. 2 illustrates a perspective view of a knockdown stand of the image forming apparatus in FIG. 1.
Figure 3:
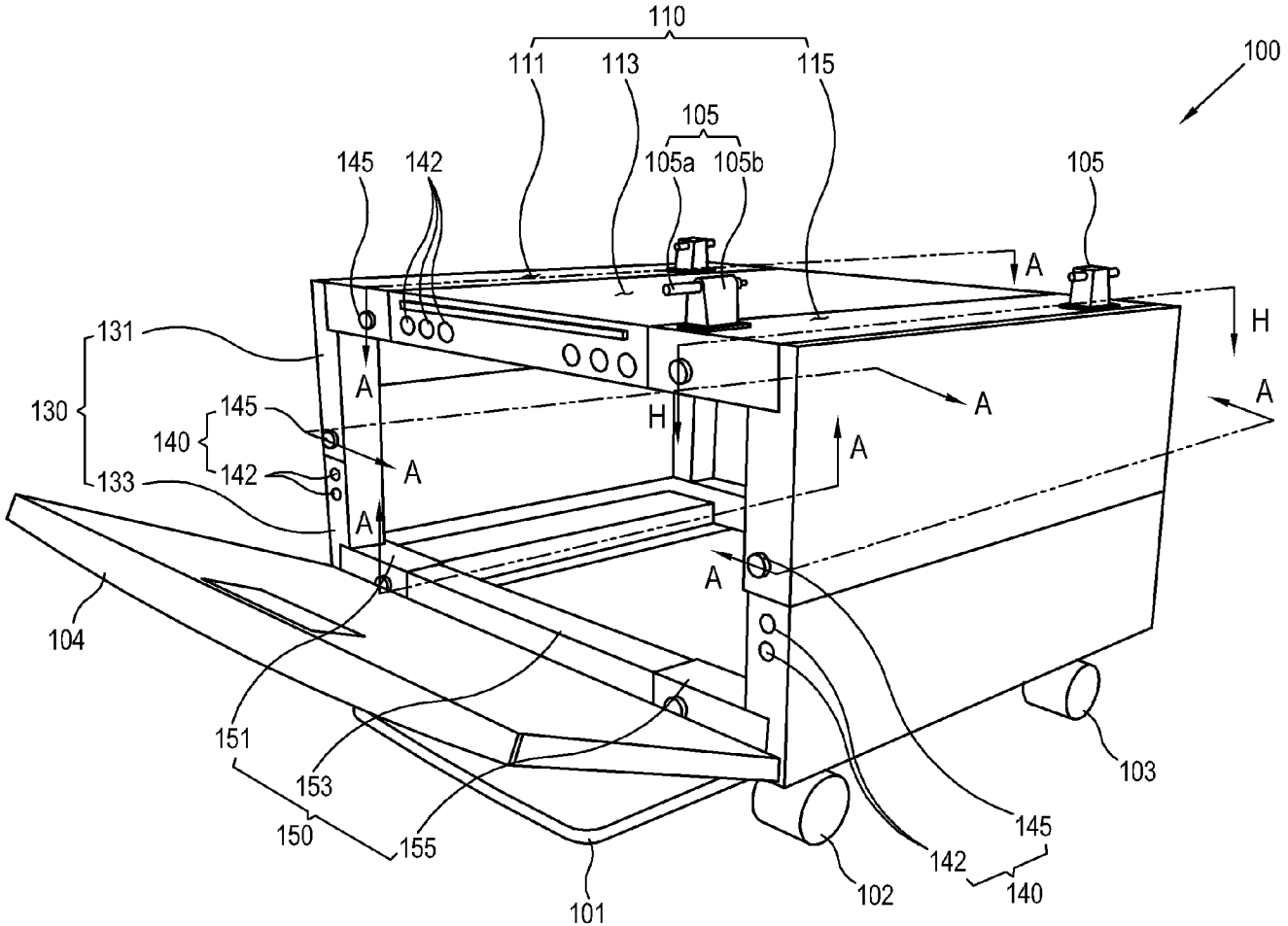
FIG. 3 is a perspective view illustrating a state of opening a cover of the knockdown stand in FIG. 2.
Figure 4:
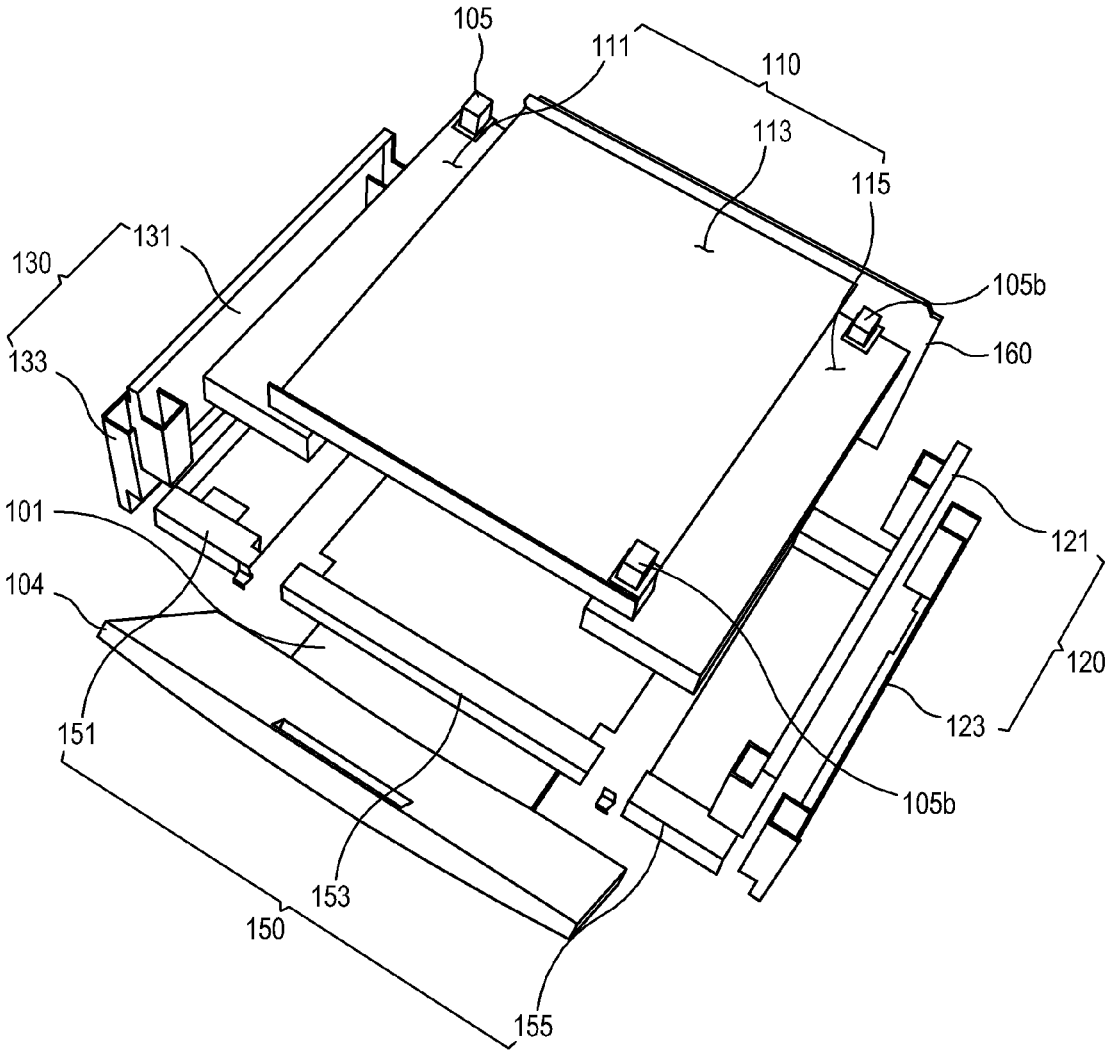
FIG. 4 illustrates a planar exploded perspective view of the knockdown stand in FIG. 2.

FIGS. 2 and 3 are, respectively, a perspective view of the knockdown stand 100 of the image forming apparatus, and a perspective view of the knockdown stand 100 in which the cover 104 is opened. Hereinafter, an exemplary configuration of the knockdown stand 100 of the image forming apparatus will be described more in detail by referring to FIGS. 2 and 3. Reference numeral 105 in FIG. 3 refers to installation mounts which permit detachably installing the printing engine 200 to the knockdown stand 100, and which protrude from an upper plate unit 110. The printing engine 200 has a recessed unit in a position corresponding to the installation mount 105, and the printing engine 200 and the installation mount 105 are prevented from being separated from each other by a coupling pin 105*a*.

The knockdown stand 100 of the image forming apparatus according to the present exemplary embodiment includes the upper plate unit 110, a lower plate unit 150, a left plate unit 120 and a right plate unit 130.

The upper plate unit 110 may include a first plate member 111, a second plate member 113 and a third plate member 115.

The left plate unit 120 may include a first plate member 121 and a second plate member 123.

The right plate unit 130 may include a first plate member 131 and a second plate member 133.

The lower plate unit 150 may include a first plate member 151, a second plate member 153 and a third plate member 155.

Figure 16:
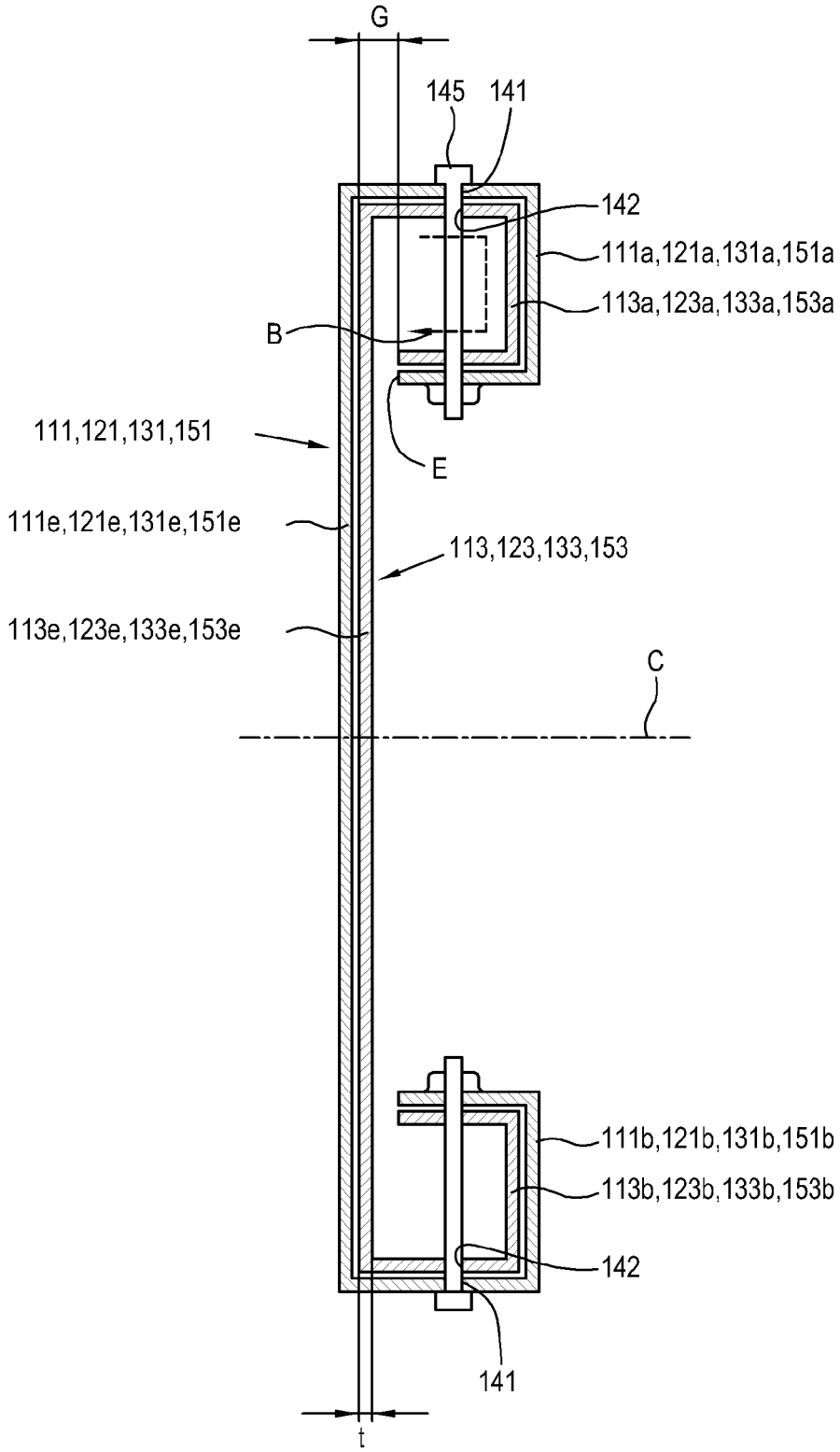
FIG. 16 illustrates an enlarged sectional view taken along line A-A of the knockdown stand in FIG. 3.

FIG. 16 is a sectional view taken along line A-A of FIG. 3. As shown in FIG. 16, the first plate members 111, 121, 131 and 151 (hereinafter, referred to 111) and the second plate members 113, 123, 133 and 153 (hereinafter, referred to 113) respectively include first surface units 111*e*, 121*e*, 131*e* and 151*e* (hereinafter, referred to 111*e*) and first bent units 111*a*, 111*b*, 121*a*, 121*b*, 131*a*, 131*b*, 151*a* and 151*b* (hereinafter, referred to 111*a*), and second surface units 113*e*, 123*e*, 133*e* and 153*e* (hereinafter, referred to 113*e*) and second bent units 113*a*, 113*b*, 123*a*, 123*b*, 133*a*, 133*b*, 153*a* and 153*b* (hereinafter, referred to 113*a*).

The first bent unit 111*a* is provided at opposite end parts of the first surface unit 111*e* forming an external appearance. Also, the first bent unit 111*a* is bent to have a bending direction B thereof which starts from the first surface unit 111*e* and bends toward the first surface unit 111*e* again. Also, the first bent unit 111*a* is provided so that there exists an interval G between an end part E of the first bent unit 111*a* and the first surface unit 111*e*.

The interval G is bigger than the thickness t of the second surface unit 113*e* of the second plate member 113. Accordingly, the second surface unit 113*e* of the second plate member 113 is capable of passing through the interval G. Also, the first bent unit 111*a* can accommodate the second bent unit 113*a* therein, that is, to allow the second bent unit 113*a* to be inserted thereinto. Accordingly, the second plate member 113 may be inserted to the first plate member 111. Also, the second plate member 113 may slidingly move when inserted into the first plate member 111.

The second bent unit 113*a* is provided at opposite end parts of the second surface unit 113*e*. The second bent unit 113*a* may also not be provided to the opposite end parts of second surface unit 113*e* as necessary. Also, as shown in FIG. 16, the second bent unit 113*a* provided to the opposite end parts of second surface unit 113*e* is illustrated to have a section symmetrical with respect to a central line C. Alternatively, the second bent unit 113*a* may be provided to have an unsymmetrical section.

Also, the second bent unit 113*a* is bent to have a bending direction B which starts from the second surface unit 113*e* and then bends toward the second surface unit 113*e* again. In FIG. 16, the bending directions of the first bent unit 111*a* and the second bent unit 113*a* are illustrated to be the same, but alternatively, the bending directions may be different.

As shown in FIGS. 3 and 16, the knockdown stand 100 of the image forming apparatus further includes a position settling unit 140 to settle the positions of the first plate member 111 and the second plate member 113.

The position settling unit 140 includes a first thru hole 141 and a second thru hole 142 respectively formed through the first bent unit 111*a* and the second bent unit 113*a*, and a coupling unit 145 penetrating the first and second thru holes 141 and 142 to be coupled. As shown in FIG. 16, the coupling unit 145 may be provided as a bolt and a nut.

In this exemplary embodiment, at least one of the first thru hole 141 and the second thru hole 142 may be provided in plural in a lengthwise direction of the first bent unit 111*a* or the second bent unit 113*a*. Accordingly, a relative position of the first plate member 111 and the second plate member 113 may be adjusted. That is, as shown in FIG. 3, since three second thru holes 142 of the second plate members 123 and 133 of the left and right plate units 120 and 130 are formed (one of them is formed to a position in which the coupling unit 145 is disposed), a relative position adjustment between the first plate member 121 and 131 and the second plate member 123 and 133 allows three steps. The number of thru holes, and thus the number of steps, is not limited, and may be greater or less than three. In this exemplary embodiment, the position of the first plate member 121 and 131 and the second plate member 123 and 133 shown in FIG. 3 is illustrated in a position making the height of the knockdown stand 100 highest.

The first and second plate members 111 and 113 may be manufactured out of a metal plate having a predetermined thickness by sheet metal forming so that the first bent unit 111*a* and the second bent unit 113*a* can be formed. In addition, the first and second plate members 111 and 113 may be manufactured by injection molding, or by coupling several components.

Also, the first bent unit 111*a* and the first surface unit 111*e*, or the second bent unit 113*a* and the second surface unit 113*e* may be integrally provided.

As shown in FIG. 16, related to a sectional forming of the first and second plate members 111 and 113, since the first and second bent units 111*a* and 113*a* having box shapes are disposed at opposite end parts thereof, the first and second plate members 111 and 113 are designed to bear an axial load which is transmitted in a lengthwise direction of the bent unit. Also, since each section of the first and second plate members 111 and 113 has an approximately I shape, the bending strength thereof is great.

In addition, the first and second plate members 111 and 113 can be manufactured out of a metal plate by sheet metal forming, thereby reducing the weight thereof.

Figure 17:
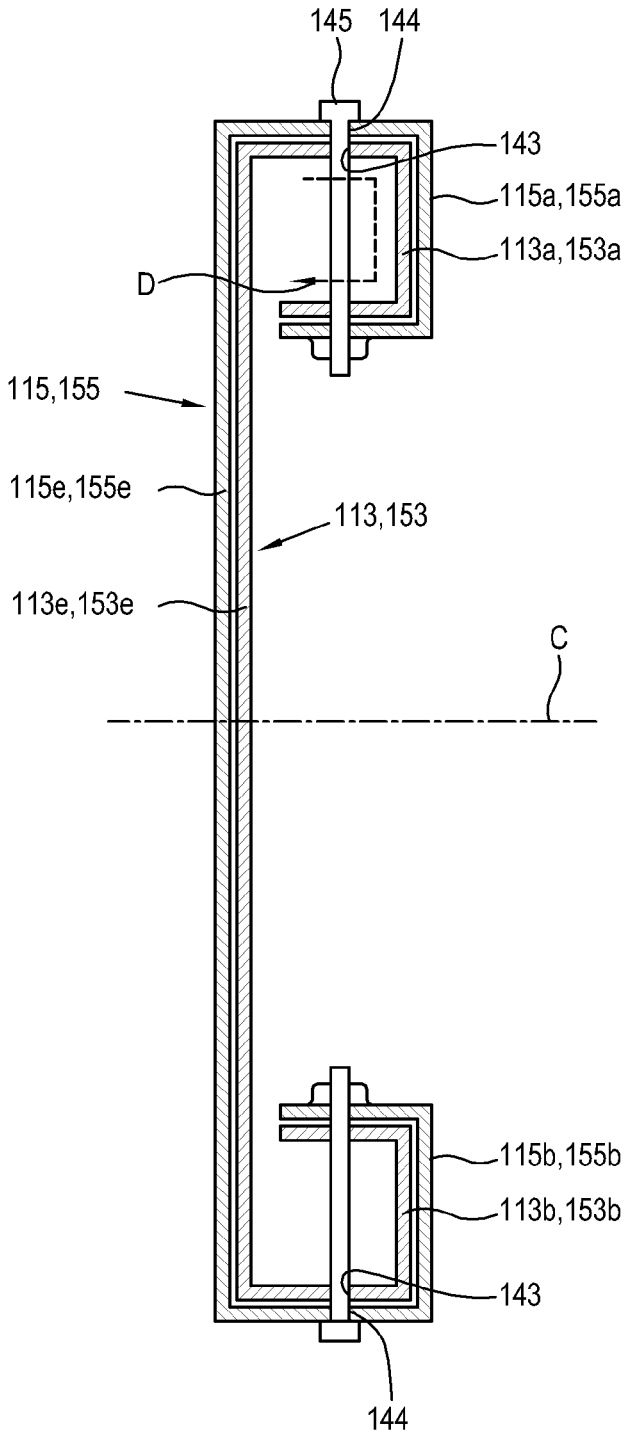
FIG. 17 illustrates an enlarged sectional view taken along line H-H of the knockdown stand in FIG. 3.

FIG. 17 is a sectional view taken along line H-H of the knockdown stand 100 in FIG. 3. The third plate member 115 of the upper plate unit 110 and the third plate member 155 of the lower plate unit 150 respectively include third surface units 115*e* and 155*e* and third bent units 115*a*, 115*b*, 155*a* and 155*b*.

The third bent units 115*a*, 115*b*, 155*a* and 155*b* are bent to have bending directions D which start from the first surface units 115*e* and 155*e* and then bend toward the first surface units 115*e* and 155*e* again.

The third plate member 115 of the upper plate unit 110 and the third plate member 155 of the lower plate unit 150 are provided so that the second plate member 113 of the upper plate unit 110 can be inserted thereinto like the first plate member 111. In greater detail, the third bent units 115*a*, 115*b*, 155*a* and 155*b* accommodate the second bent units 113*a* and 153*a* of the second plate members 113 and 153 of the upper and lower plate units 110 and 150, and the second surface units 113*e* and 153*e* of the second plate members 113 and 153 are provided to penetrate between the third bent units 115*a*, 115*b*, 155*a* and 155*b* and the third surface units 115*e* and 155*e*. Accordingly, the second plate member 113 may be inserted into the third plate member 115, and they may slidingly move in the inserted state.

The third plate member 115 of the upper plate unit 110 may be symmetrical with the first plate member 111 of the upper plate unit 110 to interpose the second plate member 113 therebetween. That is, the first plate member 111 and the third plate member 115 of the upper plate unit 110 are compatible with each other. Accordingly, if two first plate members 111 are manufactured, one of them may be used as the third plate member 115.

Also, the position settling unit 140 may further include a third thru hole 143 and a fourth thru hole 144 respectively formed through the second bent units 113*a*, 113*b*, 153*a* and 153*b* and the third bent units 115*a*, 115*b*, 155*a* and 155*b*, and a coupling unit 145 penetrating the third and fourth thru holes 143 and 144 to be coupled. Accordingly, relative positions between the second plate members 113 and 153 and the third plate members 115 and 155 may be stationary. The number of thru holes is not limited to any particular number, and any number of thru holes may be formed.

The upper and lower plate units 110 and 150 may be symmetrical with each other with respect to a horizontal central surface which is in parallel with the upper and lower plate units 110 and 150 and is equidistant from the upper and lower surfaces of the upper and lower plate units 110 and 150. That is, the upper plate unit 110 and the lower plate unit 150 are compatible with each other. Accordingly, if two upper plate units 110 are manufactured, one of them may be used as the lower plate unit 150. In greater detail, if four first plate members 111 of the upper plate unit 110 are manufactured, three of them may be used as the third plate member 115 of the upper plate unit 110, and the first plate member 151 and the third plate member 155 of the lower plate unit 110, thereby reducing a manufacturing cost.

Also, the left and right plate units 120 and 130 may be symmetrical with each other with respect to a vertical central surface which is in parallel with the left and right plate units 120 and 130 and equidistant from the left and right surfaces of the left and right plate units 120 and 130. That is, the left plate unit 120 and the right plate unit 130 are compatible with each other. Accordingly, if two left plate units 120 are manufactured, one of them may be used as the right plate unit 130, thereby reducing a manufacturing cost.

FIGS. 4 to 8 are exploded views illustrating a main portion of the knockdown stand 100 of the image forming apparatus.

The upper and lower plate units 110 and 150 are assembled as the second plate members 113 and 153 are inserted into the first plate members 111 and 151 and the third plate members 115 and 155. The left and right plate units 120 and 130 are assembled as the second plate members 123 and 133 are inserted to the first plate members 121 and 131.

Figure 5:
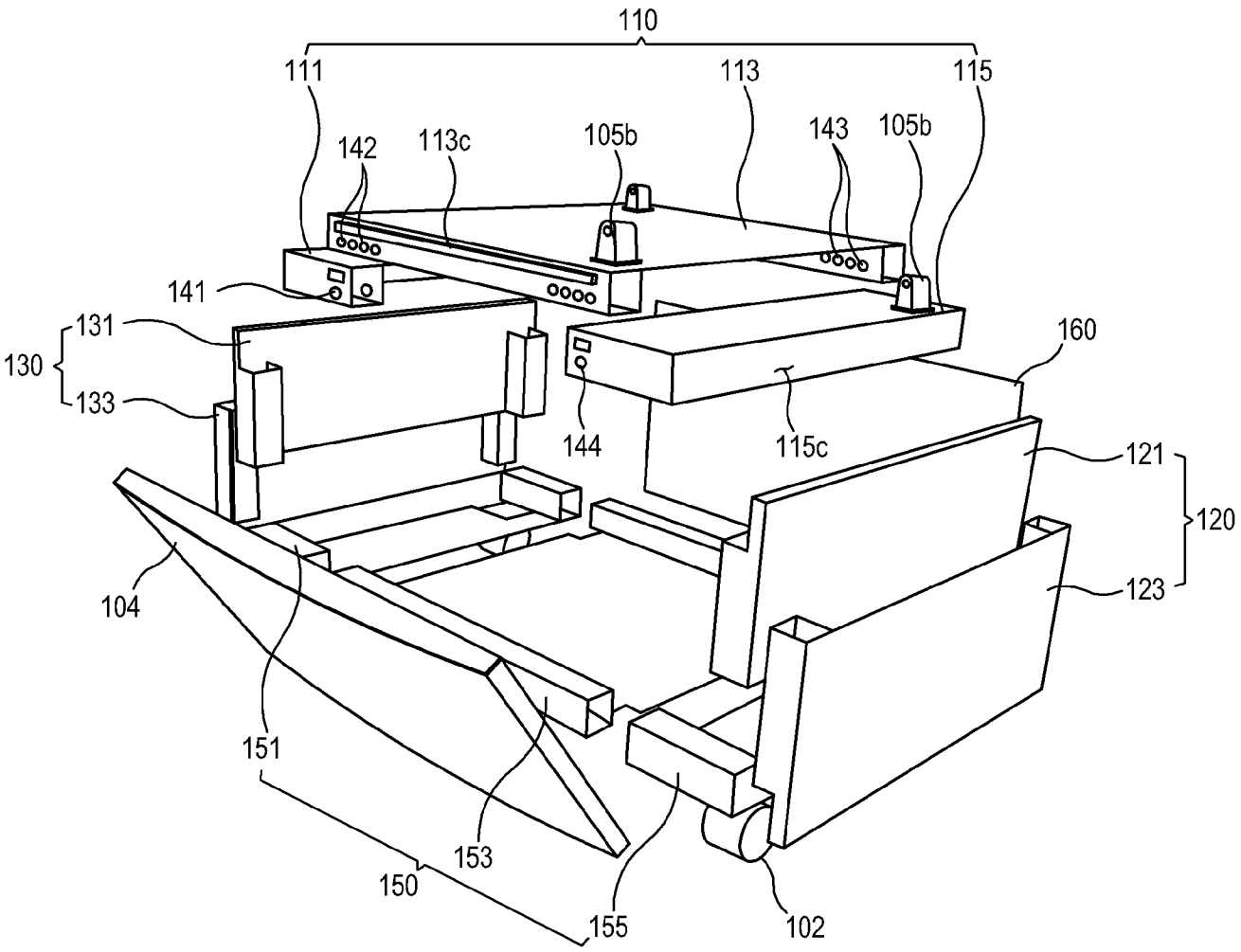
FIG. 5 illustrates a side exploded perspective view of the knockdown stand in FIG. 2.
Figure 6:
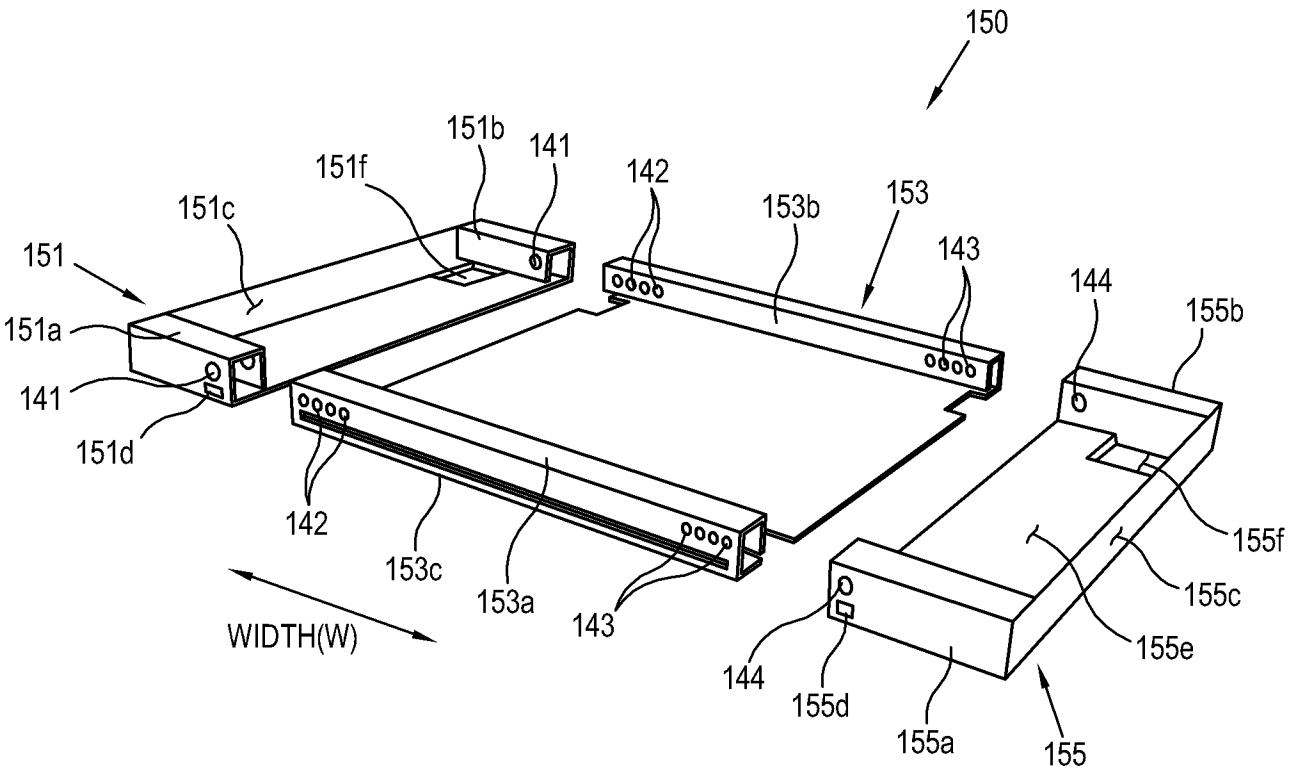
FIG. 6 illustrates a main portion perspective view for describing a width adjustment of the knockdown stand in FIG. 2.
Figure 8:
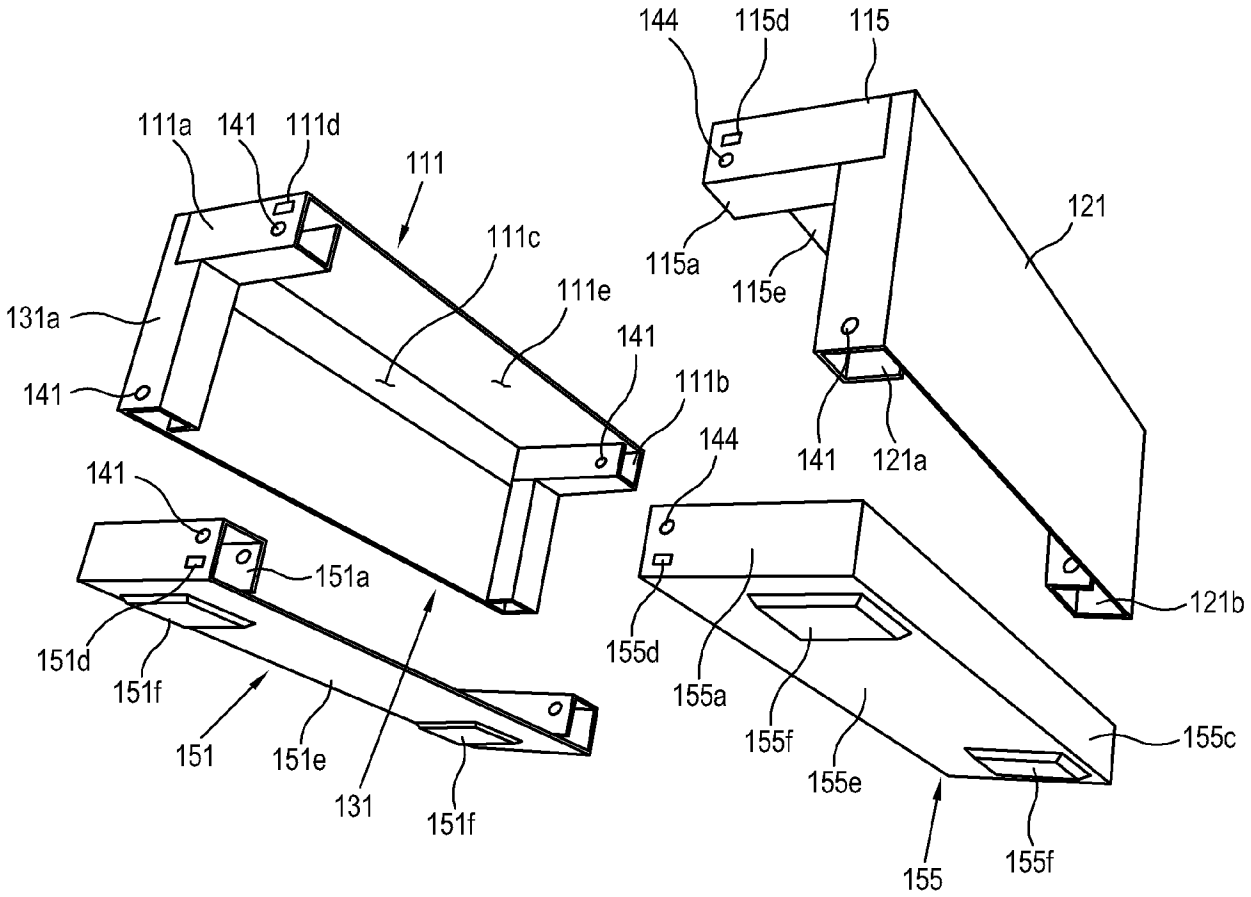
FIG. 8 illustrates a main portion perspective view of the knockdown stand in FIG. 2.

Here, as shown in FIGS. 5, 6 and 8, the first plate members 111 and 151 and the third plate members 115 and 155 of the upper and lower plate units 110 and 150 respectively include sub bent units 111*c*, 115*c*, 151*c* and 155*c* bent from the first surface units 111*e* and 151*e* and the third surface units 115*e* and 155*e* to cover the first bent units 111*a* and 151*a* and the third bent units 115*a* and 155*a*.

The first plate members 111 and 151 and the third plate members 115 and 155 of the upper and lower plate units 110 and 150 as well as the sub bent units 111*c*, 115*c*, 151*c* and 155*c* may be integrally formed by sheet metal forming. Accordingly, piece components of the first plate members 111 and 151 and the third plate members 151 and 155 may be further easily manufactured.

Hereinafter, an adjusting method of the width w and height h of the knockdown stand 100 of the image forming apparatus will be described by referring to FIGS. 6 and 7.

As shown in FIG. 6, the first thru hole 141 is formed through the first bent units 151*a* and 151*b* of the first plate member 151 of the lower plate unit 150, and the second thru hole 142 is formed through first sides of the second bent units 153*a* and 153*b* of the second plate member 153.

Also, the third thru hole 143 is formed through second sides of the second bent units 153*a* and 153*b* of the second plate member 153, and the fourth thru hole 144 is formed through the third bent units 155*a* and 155*b* of the third plate member 155.

A single first thru hole 141 and a single fourth thru hole 144 are illustrated, and four second thru holes 142 and four third thru holes 143 are illustrated. However, the number thereof may vary, and may be the opposite, without limitation. Also, the number thereof may vary according to the number of adjustment steps to which the width w can be adjusted.

The relative position of the first plate member 151 and the second plate member 153 may be adjusted by aligning one of the second thru holes 142 of the second plate member 153 with the first thru hole 141, and then coupling them with the coupling unit 145, as illustrated in FIG. 16. Also, the relative position of the second plate member 153 and the third plate member 155 may be adjusted by aligning one of the third thru holes 143 of the second plate member 153 with the fourth thru hole 144, and then coupling them with the coupling unit 145, as illustrated in FIG. 17.

Thus, by aligning the positions of the first thru hole 141 and the second thru hole 142, and the third thru hole 143 and the fourth thru hole 144, the width w of the lower plate unit 150 of the knockdown stand 100 of the image forming apparatus may be determined.

The total width of the knockdown stand 100 of the image forming apparatus may be adjusted by adjusting the width of the upper plate unit 110 as described above with respect to the lower plate unit 150.

As described above, if the numbers of the second thru holes 142 and the third thru holes 143 are respectively four, the knockdown stand 100 of the image forming apparatus may be adjusted in total sixteen width steps. However, this is no limitation to the number of steps which may be provided.

Hereinafter, an adjusting method of the height h of the knockdown stand 100 of the image forming apparatus will be described by referring to FIG. 7.

The first thru hole 141 is formed through the first bent units 131*a* and 131*b* of the first plate member 131 of the right plate unit 130, and the second thru hole 142 is formed through the second bent units 133*a* and 133*b* of the second plate member 133.

The relative position of the first plate member 131 and the second plate member 133 may be adjusted by aligning the first thru hole 141 and the second thru hole 142, and then coupling them with the coupling unit 145 in FIG. 16.

Since three second thru holes 142 of the right plate unit 130 are formed, the relative position thereof may be adjusted in three steps. However, this is no limitation to the number of steps which may be provided.

The left plate unit 120 is provided similarly to the right plate unit 130 so that the relative position of the first plate member 121 and the second plate member 123 may be adjusted.

Accordingly, by adjusting the relative position between the first plate members 121 and 131 and the second plate members 123 and 133 of the left and right plate units 120 and 130, the height h of the knockdown stand 100 of the image forming apparatus may be adjusted. Since three second thru holes 142 are formed through the left and right plate units 130, the height h may be adjusted in three steps. However, this is no limitation to the number of steps which may be provided and if more steps or smaller steps to adjust the height h are desired, the number of the second thru holes 142 formed through the left and right plate units 130 may be increased and/or formed more closely together.

The upper plate unit 110 and the left and right plate units 120 and 130 (precisely, the first plate members 121 and 131 of the left and right plate units 120 and 130) of the knockdown stand 100 of the image forming apparatus may be coupled with each other by welding.

Figure 7:
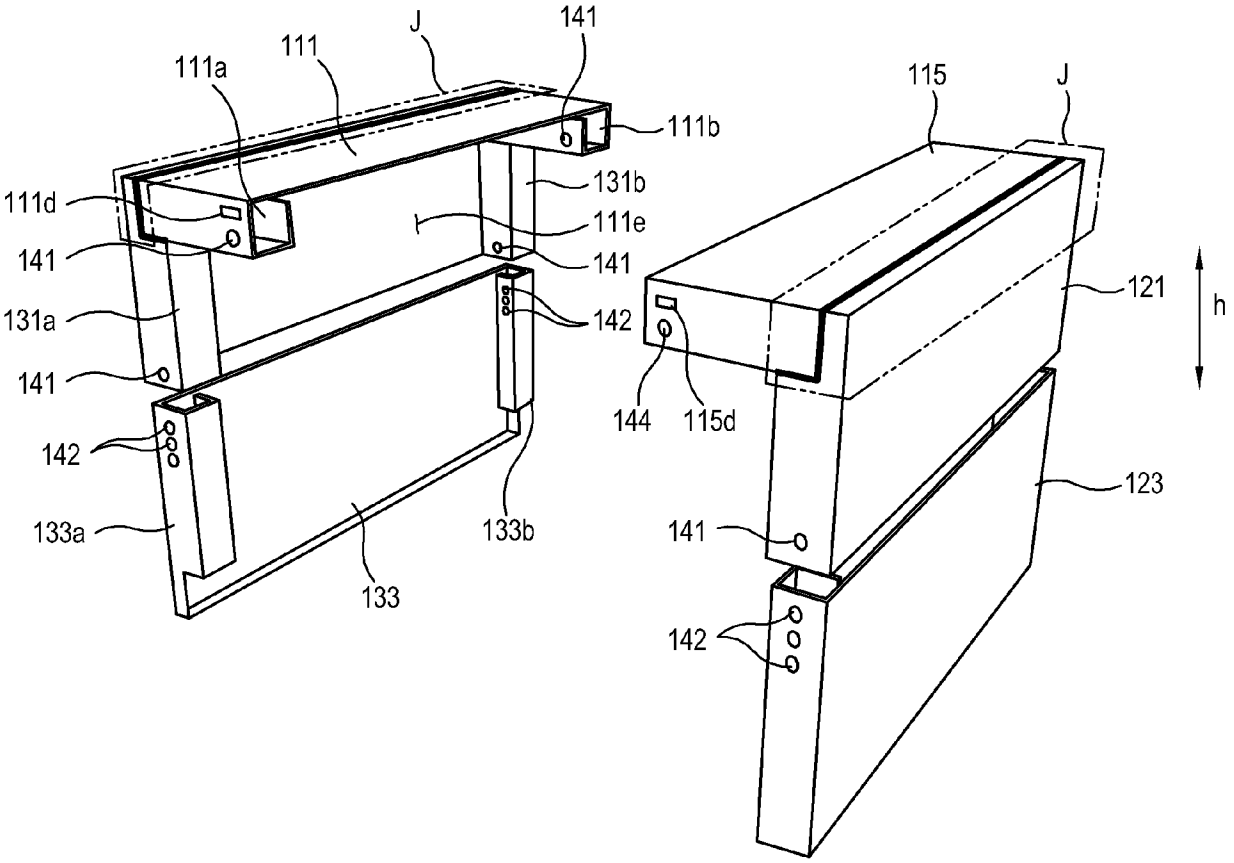
FIG. 7 illustrates a main portion perspective view for describing a height adjustment of the knockdown stand in FIG. 2.

In greater detail, as shown in FIG. 7, the first plate member 111 of the upper plate unit 110 and the first plate member 131 of the right plate unit 130 may be coupled to each other by welding. They may be welded along a contact part J in which the first plate member 111 of the upper plate unit 110 and the first plate member 131 of the right plate unit 130 contact each other.

Also, the third plate member 115 of the upper plate unit 110 and the first plate member 121 of the left plate unit 120 may be welded along a contact part J in which they contact each other like the first plate member 111 of the upper plate unit 110.

The lower plate unit 150 and the left and right plate units 120 and 130 (precisely, the second plate members 123 and 133 of the left and right plate units 120 and 130) of the knockdown stand 100 of the image forming apparatus may be coupled with each other by welding.

Figure 12:
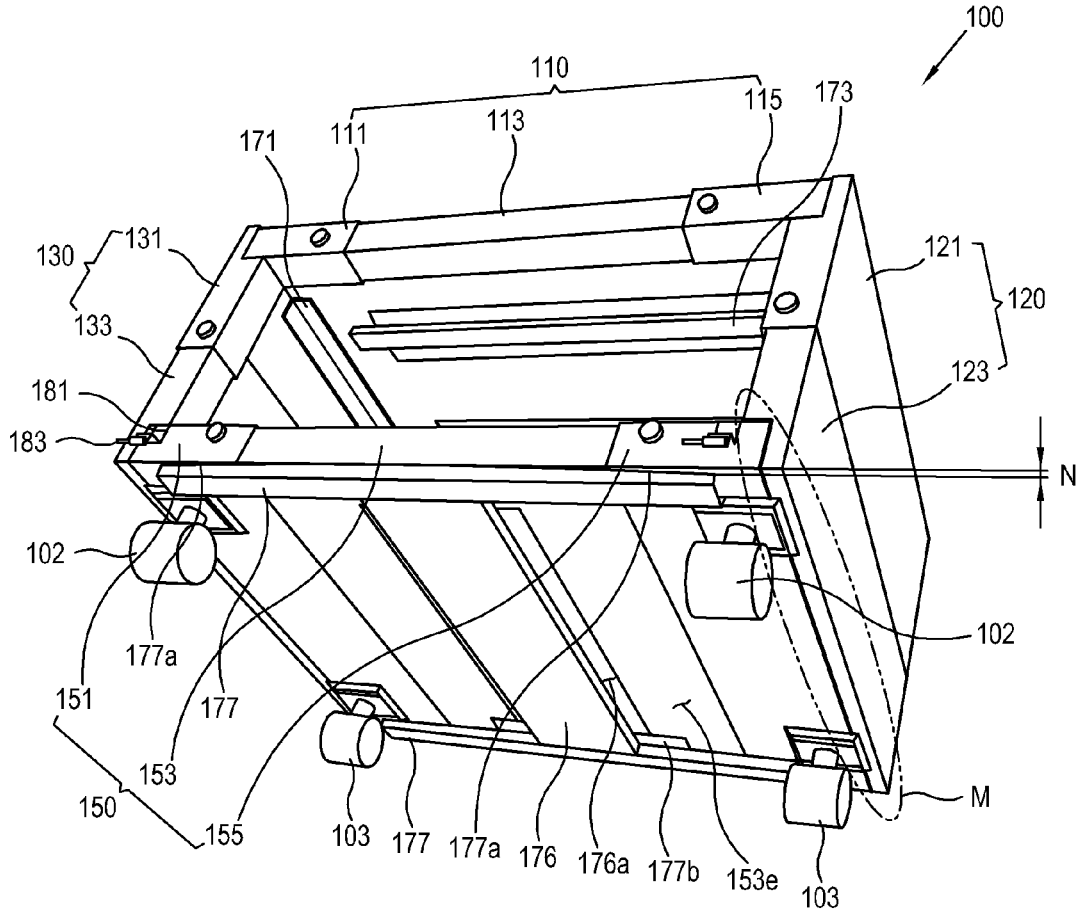
FIG. 12 illustrates a rear perspective view of the knockdown stand in FIG. 2.

In greater detail, as shown in FIG. 12, the first plate member 151 of the lower plate unit 150 and the second plate member 133 of the right plate unit 130 may be coupled to each other by welding. They may be welded along a contact portion in which the first plate member 151 of the lower plate unit 150 and the second plate member 133 of the right plate unit 130 contact each other.

Also, as shown in FIG. 12, the third plate member 155 of the lower plate unit 150 and the second plate member 123 of the left plate unit 120 may be welded along a contact part M in which they contact each other similar to the first plate member 151 of the lower plate unit 150.

Since it is difficult to move the knockdown stand 100 of the image forming apparatus to an installation site because of the volume thereof, the volume thereof may be minimized during being moved by the following method.

Since each second plate member 113 and 153 of the upper plate unit 110 and the lower plate unit 150 is detachably coupled with the first plate members 111 and 151 and the third plate members 115 and 155 by coupling unit (for example, a bolt and nut), the second plate members 113 and 153 can be moved to an installation site in a piece component state.

Also, the first plate member 111 of the upper plate unit 110 and the first plate member 131 of the right plate unit 130 coupled by welding may be moved in a previously-welded state. The other components coupled by welding, that is, the third plate member 115 of the upper plate unit 110 and the first plate member 121 of the left plate unit 120, the first plate member 151 of the lower plate unit 150 and the second plate member 133 of the right plate unit 130, and the third plate member 155 of the lower plate unit 150 and the second plate member 123 of the left plate unit 120 also may be moved to the installation site in a previously-welded state.

Accordingly, four previously welded assembling components having an approximate L shape and two second plate members 113 and 153 can be moved to an installation site in a separated state, and then can be assembled at the installation site. Accordingly, the volume thereof may be minimized during moving.

Also, since it is possible to complete a final assembly by using only the coupling unit 145 in assembling, any one may conveniently assemble and install stand 100 at the installation site.

As shown in FIG. 8, the first plate member 151 and the third plate member 155 of the lower plate unit 150 may further include roller installing units 151*f* and 155*f* provided to install the front rollers 102 and the rear rollers 103.

The roller installing units 151*f* and 155*f* may protrude toward the rollers 102 and 103 from the first surface unit 151*e* and the third surface unit 155*e* to increase strength.

The first plate members 111 and 151 and the third plate members 115 and 155 of the upper and lower plate units 110 and 150 may further include guide protrusions 111*d*, 151*d*, 115*d* and 155*d*.

To correspond thereto, as shown in FIGS. 5 and 6, the second plate members 113 and 153 of the upper and lower plate units 110 and 150 may further include guide grooves 113*c* and 153*c* extending in lengthwise directions of the second bent units 113*a*, 113*b*, 153*a* and 153*b*.

Accordingly, the guide protrusions 111*d*, 151*d*, 115*d* and 155*d* are accommodated to the guide grooves 113*c* and 153*c* to be guided along the guide grooves 113*c* and 153*c*. The first plate members 111 and 151 and the third plate members 115 and 155 of the upper and lower plate units 110 and 150 may smoothly slide against the second plate members 113 and 153.

FIGS. 9 to 13 are perspective views illustrating a reinforcing member disposed to reinforce the knockdown stand 100 of the image forming apparatus.

Figure 9:
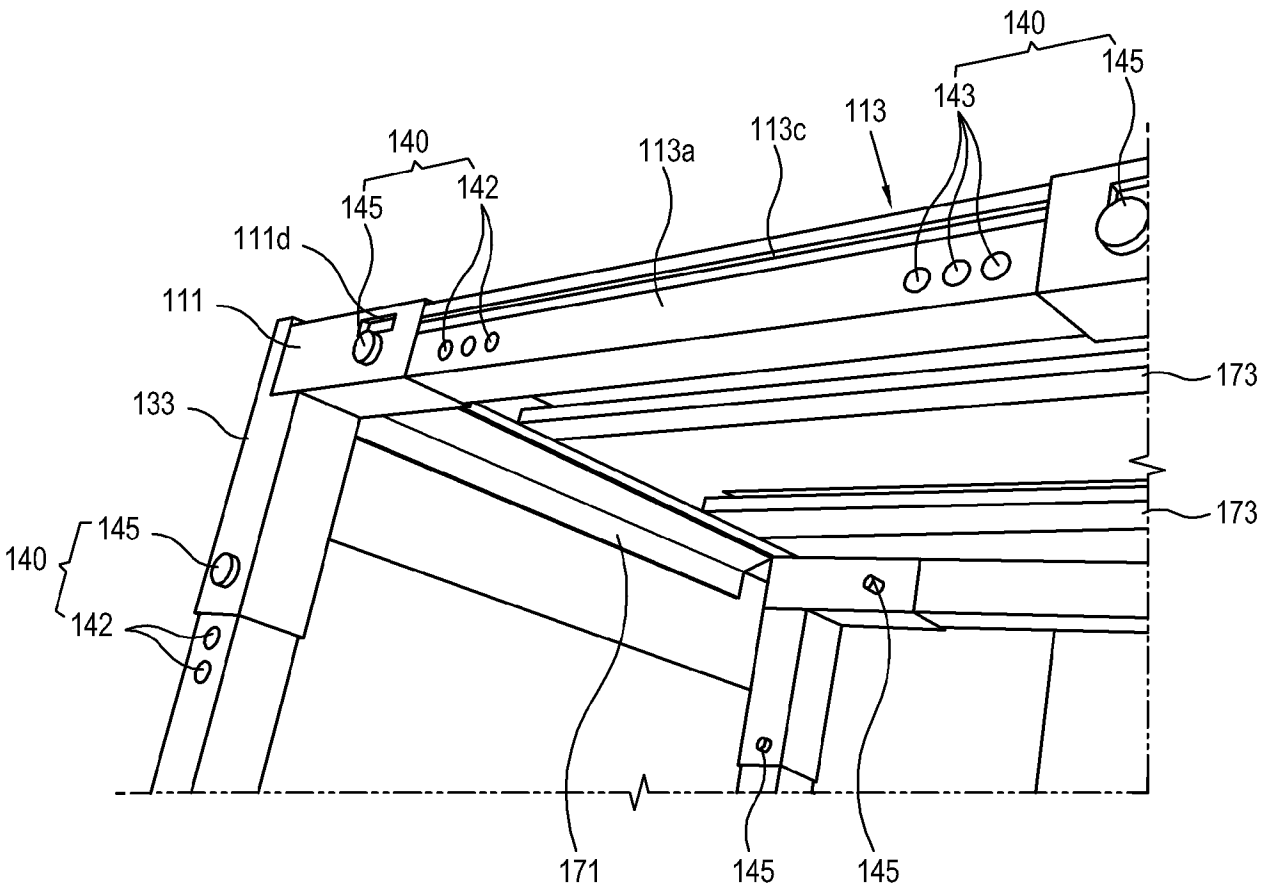
FIG. 9 illustrates a main portion perspective view of a reinforcing member reinforcing an edge of an upper plate unit of the knockdown stand in FIG. 2.

As shown in FIG. 9, a reinforcing angle 171 may be disposed to a boundary edge of the upper plate unit 110 and the left and right plate units 120 and 130.

The reinforcing angle 171 may have a section of an L shape, and may be disposed to a boundary surface between the first surface unit 111*e* in FIG. 8 of the first plate member 111 of the upper plate unit 110 and the sub bent unit 111*c* in FIG. 8.

The reinforcing angle 171 may be coupled to the first plate member 111 by a coupling unit such as a rivet or any other coupling unit. The reinforcing angle 171 may be moved to an installation site in the state that the reinforcing angle 171 is coupled to the first plate member 111.

Figure 10:
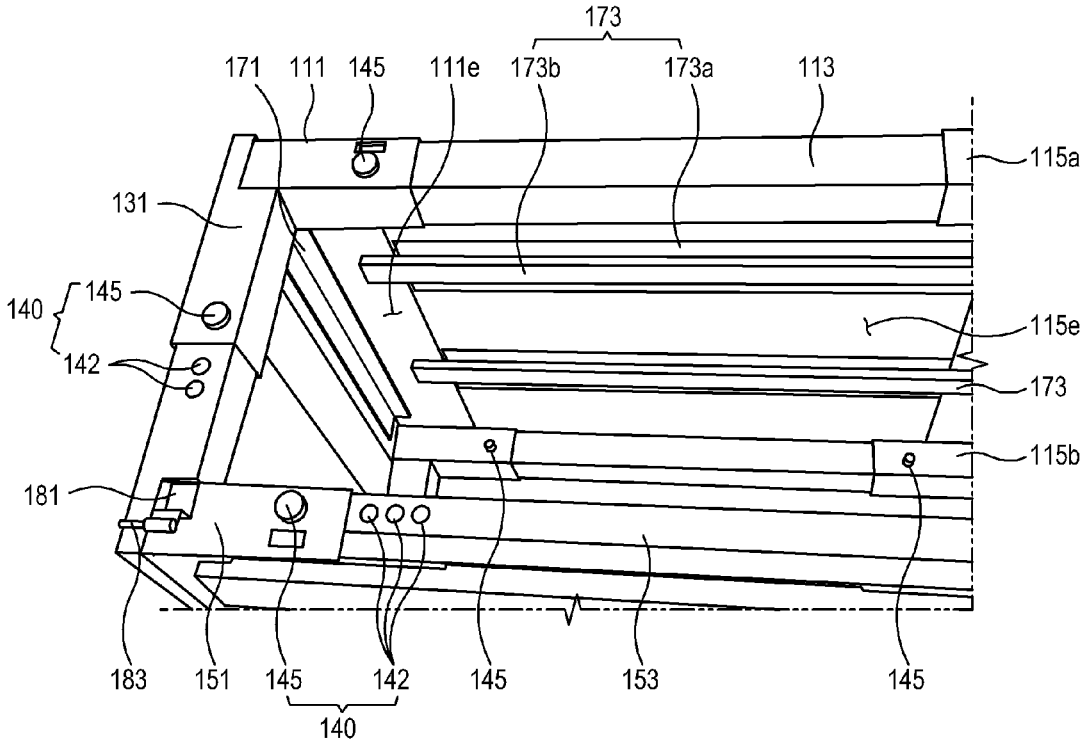
FIG. 10 illustrates a main portion perspective view of a reinforcing member reinforcing a central part of the upper plate unit of the knockdown stand in FIG. 2.

Also, as shown in FIGS. 9 and 10, a stiffener 173 for reinforcing the second surface unit 113*e* of the second plate member 113 of the upper plate unit 110 may be disposed.

The stiffener 173 may be disposed in parallel with the lengthwise direction of the second bent unit 113*a*, and the cross-section thereof may have at least one of a hat shape, an L shape and a C shape. The sectional shape is not particularly limited, and may vary as long as stiffener 173 reinforces the second plate member 113.

Here, the stiffener 173 may further include a flange 173*a* coupled to the second surface unit 113*e* by a coupling unit such as a rivet or any other coupling unit.

When the knockdown stand 100 is transported to an installation site, the stiffener 173 may be transported assembled to the second plate 113.

Figure 11:
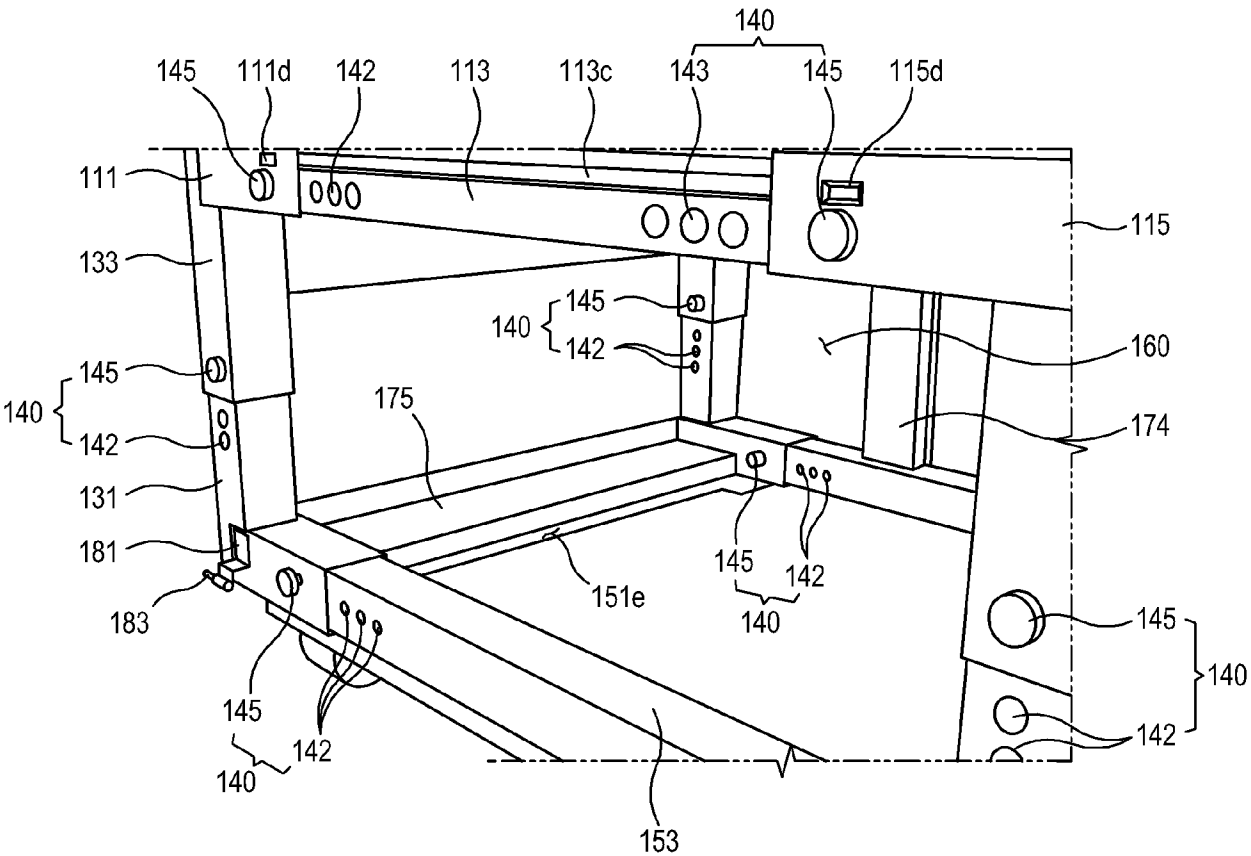
FIG. 11 illustrates a main portion perspective view of a reinforcing member reinforcing an edge of a lower plate unit of the knockdown stand in FIG. 2.

FIG. 11 illustrates a corner reinforcing member 175 for reinforcing a corner portion between the left and right plate units 120 and 130 and the lower plate unit 150.

The corner reinforcing member 175 may have a cross-section of a hat shape, and may be coupled to the first surface unit 151*e* of the first plate member 151 of the lower plate unit 150. The corner reinforcing member 175 may be coupled by a coupling unit such as a rivet, or may be coupled by any other coupling unit.

Also, the corner reinforcing member 175 may be similarly disposed to the third surface unit 155*e* (illustrated in FIG. 8) of the third plate member 155 of the lower plate unit 150.

FIG. 12 illustrates lower reinforcing members 176 and 177 disposed to a lower surface of the lower plate unit 150.

A first lower reinforcing member 177 extends in opposite directions toward the first plate member 151 and the third plate member 153 along a lengthwise direction of the second bent unit 153*a* of the second plate member 153 of the lower plate unit 150.

The first lower reinforcing member 177 is coupled to the second surface unit 153*e* of the second plate member 153, and the opposite sides 177*a* thereof are distanced by a predetermined interval N from the second surface unit 153*e* to prevent interference against the first and third plate members 151 and 153 as the first lower reinforcing member 177 extends toward the first plate member 151 and the third plate member 153. Here, the interval N is bigger than the thickness of the first and third plate members 151 and 153.

Accordingly, the first plate member 151 and the third plate member 153, and the first lower reinforcing member 177 may be prevented from interfering with each other.

As shown in FIG. 12, the first lower reinforcing member 177 may be respectively disposed two places to a front end part and a rear end part.

The first lower reinforcing member 177 may further include a flange 177*b* for being coupled to the second surface unit 153*e* by a coupling unit such as a rivet.

A second lower reinforcing member 176 is disposed to a lower surface of the second surface unit 153*e* in a crossing direction with respect to the first lower reinforcing member 177.

The second lower reinforcing member 176 may include a flange 176*a* coupled to the second surface unit 153*e* by a coupling unit such as a rivet.

The second lower reinforcing member 176 is illustrated to have a hat shape section in FIG. 12, but the section may have various shapes.

Figure 13:
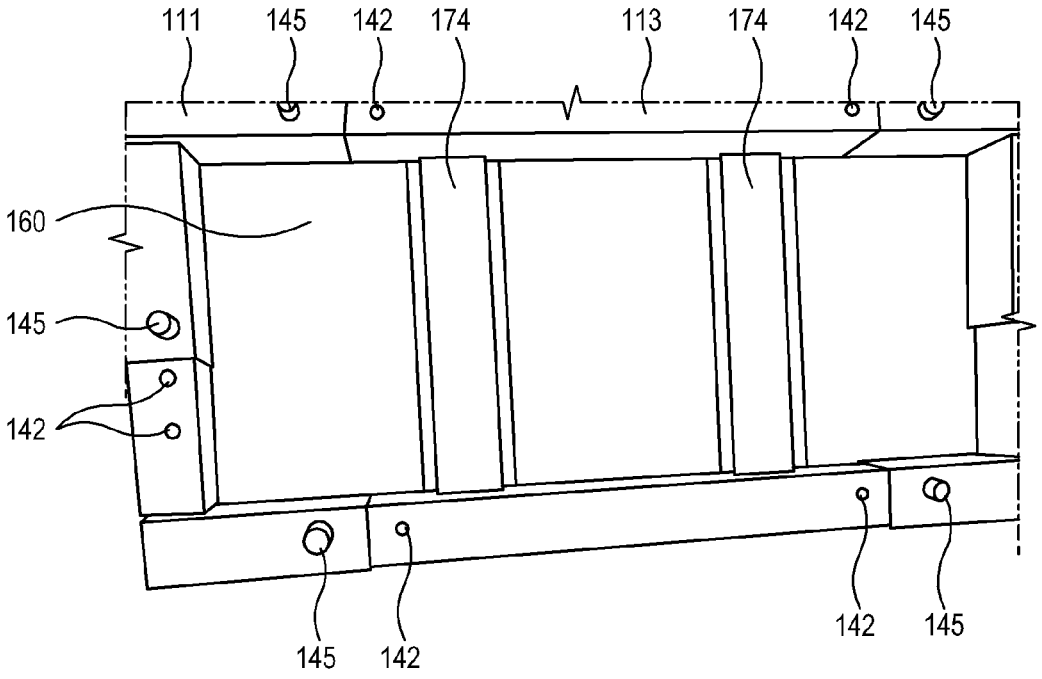
FIG. 13 illustrates a front perspective view of the knockdown stand in FIG. 2.

FIG. 13 illustrates a bottom reinforcing member 174 for reinforcing a bottom plate 160.

In the drawings, the bottom plate 160 is illustrated as an element of the knockdown stand 100 according to the present general inventive concept, but it may be omitted as necessary. The bottom plate 160 may be moved to an installation site in a piece component state, and may be detachably coupled to the bottom in the state that the upper and lower plate units 110 and 150 and the left and right plate units 120 and 130 are all coupled. The bottom plate 160 may be coupled to the knockdown stand 100 by an insertion coupling or an engagement coupling.

The bottom reinforcing member 174 may extend in a height direction h as illustrated in FIGS. 7 and 13 along the bottom plate 160. The bottom reinforcing member 174 may be coupled to the bottom plate 160 by a coupling unit such as a rivet. Also, the section thereof is illustrated to have a hat shape in FIG. 13, but other shape sections may be employed as necessary.

The above reinforcing members, which are the reinforcing angle 171, the stiffener 173, the corner reinforcing member 175, the first lower reinforcing member 177, the second lower reinforcing member 176 and the bottom reinforcing member 174 may be all moved to an installation site coupled to each piece component.

As described above, the height h and width w of the knockdown stand 100 of the image forming apparatus are capable of being adjusted, and these are determined appropriately to a model of the printing engine 200. That is, if the model of the printing engine 200 is different and the width w and height h thereof are to be different, the knockdown stand 100 may be commonly used with a plurality of printing engines 200 without the necessity of making numerous separate stands. Accordingly, a manufacturing cost of the image forming apparatus 1 may be reduced.

In the knockdown stand 100, the cover 104 and the bottom plate 160 may employ other kinds according to the model of the printing engine 200. In greater detail, by disposing the cover 104 and the bottom plate 160 corresponding to the model of the printing engine 200 in the state that the upper and lower plate units 110 and 150 and the left and right plate units 120 and 130 are assembled according to the model of the printing engine 200 at an installation site, the assembling of the knockdown stand 100 is completed. Also, an inner space of the knockdown stand 100 may accommodate a toner cartridge, an ink cartridge or other expendables.

As shown in FIGS. 10 and 12, a cover installing angle 181 is disposed to the first plate member 151 and the third plate member 153 of the lower plate unit 150. Also, a hinge pivot 183 is disposed to the cover installing angle 181. Here, the cover 104 is rotatably disposed about the hinge pivot 183. Also, the cover 104 may be formed of a plastic material.

In the above, the upper plate unit 110 and the lower plate unit 150 are illustrated to respectively include three plate members 111, 113 and 115, and 151, 153 and 155. Alternatively, the upper plate unit 110 and the lower plate unit 150 may include only two plate members, that is, first plate members 111 and 151 and second plate members 153 and 155.

Hereinafter, a knockdown stand 100*a* for an image forming apparatus according to a second exemplary embodiment of the present general inventive concept will be described by referring to FIGS. 14 and 15.

The knockdown stand 100*a* of the image forming apparatus according to the second exemplary embodiment of the present general inventive concept includes an upper plate unit 110*a* and a lower plate unit 150. The knockdown stand 100 according to the first exemplary embodiment is a large size knockdown stand including the left and right plate units 120 and 130, but the knockdown stand 100*a* according to the second exemplary embodiment is a small size knockdown stand.

Figure 14:
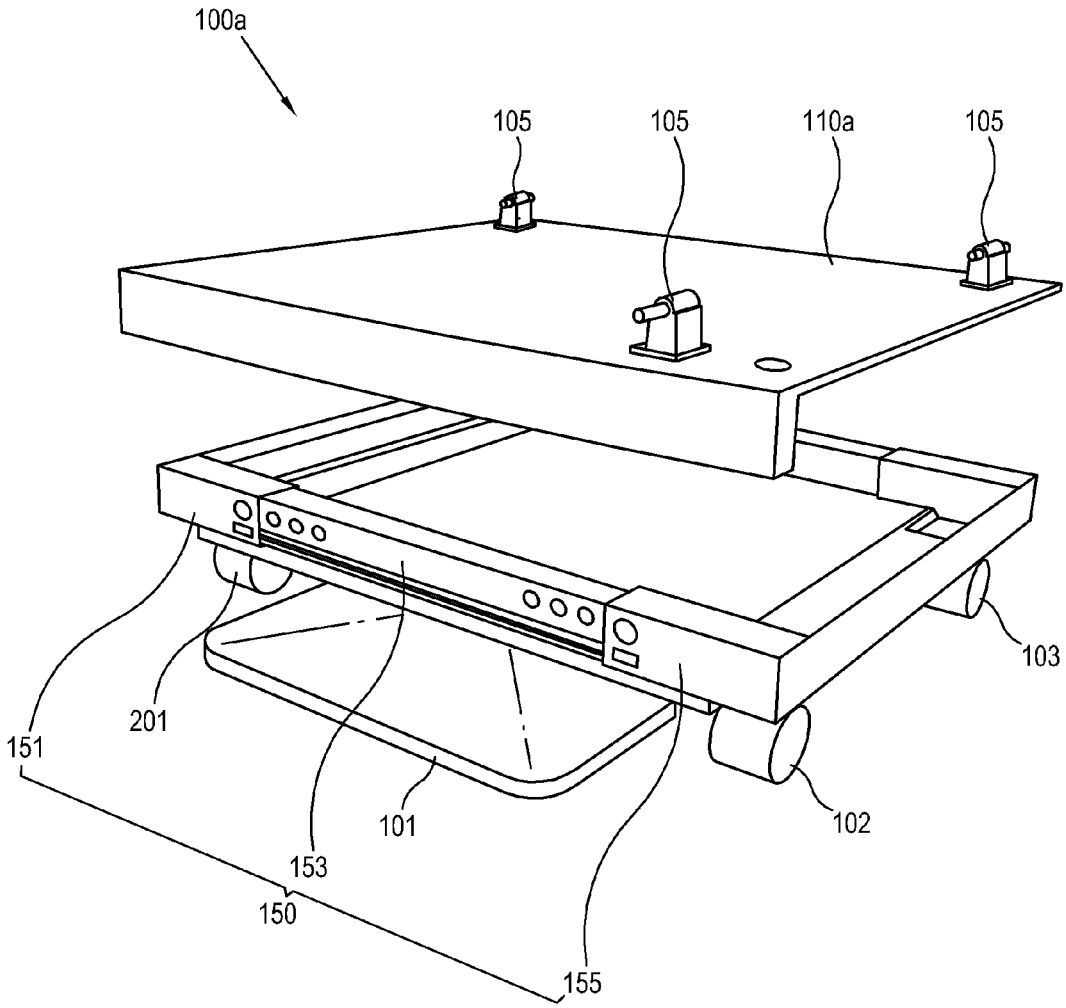
FIG. 14 illustrates an exploded perspective view of a knockdown stand of an image forming apparatus according to a second exemplary embodiment of the present general inventive concept.
Figure 15:
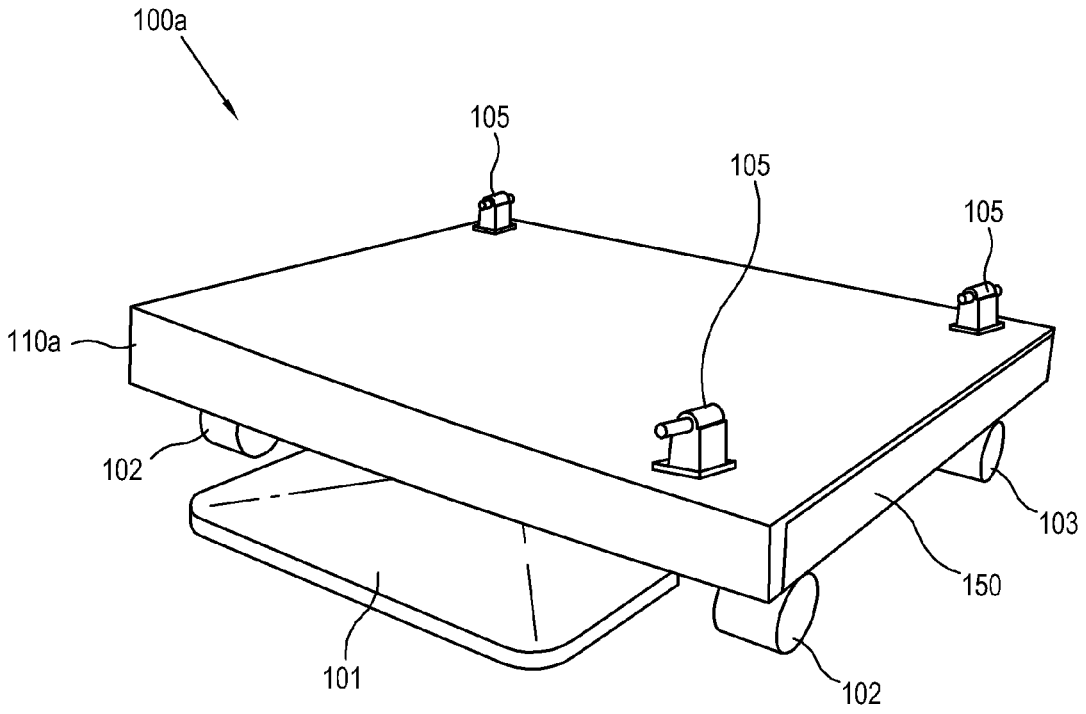
FIG. 15 illustrates an assembling completion view of the knockdown stand in FIG. 14.

As shown in FIG. 14, the upper plate unit 110*a* has an L shape section, and is disposed to an upper side of the lower plate unit 150 to cover the lower plate unit 150.

An installation mount 105 for installing a printing engine 200 is disposed to an upper part of upper plate unit 110*a*.

The lower plate unit 150 according to the present exemplary embodiment may have the same configuration as the lower plate unit 150 according to the first exemplary embodiment describe above.

The width w of the knockdown stand 100*a* of the image forming apparatus may be adjusted by the lower plate unit 150.

As described above, a stand of an image forming apparatus and an image forming apparatus having the same according to the present general inventive concept have the following effects.

First, a manufacturing cost may be reduced. The height and width of the stand may be adjusted according to a model of a printing engine, thereby superiorly reducing a manufacturing cost in comparison to manufacturing a knockdown stand by each model.

Second, the weight of the printing engine may be stably supported.

Third, in transporting the knockdown stand to an installation site in which the image forming apparatus is to be installed, it is sufficient to assemble the knockdown stand in the installation site after transporting the stand in a disassembled state, thereby minimizing the volume thereof. Accordingly, transportation of the knockdown stand becomes more convenient, and more knockdown stands are capable of being loaded in a uniform loading space, thereby reducing a transporting cost.

Fourth, the total thereof is disassembled just by uncoupling a coupling unit, and the total thereof is assembled just by coupling the coupling unit, thereby permitting convenient assembly and disassembly.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A stand of an image forming apparatus, the stand comprising:

an upper plate unit comprising:

a first plate member; and a second plate member capable of being slidably inserted into the first plate member, a first dimension of the stand being determined by a relative position of the first plate member and the second plate member, and at least one of the first plate member and the second plate member being adjustable to determine a second dimension of the stand different from the first dimension and corresponding to a height of the stand; and a lower plate unit capable of being slidably inserted into the upper plate unit, the second dimension of the stand being determined by a relative position of the upper plate unit and the lower plate unit.

2. The stand of claim 1, wherein the first dimension is a width of the stand.

3. The stand of claim 1, wherein the lower plate unit forms a lower side of the image forming apparatus.

4. The stand of claim 1, wherein the second plate member is fixed to the first plate member to inhibit movement of the second plate member with respect to the first plate member along a sliding direction of the second plate member.

5. The stand of claim 1, wherein the first plate member is slidably movable in a lengthwise direction of the second plate member, the sliding movement enabling the adjustable insertion of the second plate member into the first plate member.

6. The stand according to claim 1, further comprising a position settling unit which determines a fixed position of the second plate member with respect to the first plate member.

7. The stand according to claim 1, further comprising:

a coupling unit to couple the first plate member and the second plate member, the coupling unit being capable of being inserted into first and second through holes respectively formed in the first plate member and the second plate member.

8. The stand according to claim 7, wherein at least one of the first and second through holes is formed as one of a plurality of through holes provided in a lengthwise direction of a corresponding one of the first and second plate members, to permit adjustment of a relative position between the first plate member and the second plate member.

9. The stand according to claim 1, wherein the upper plate unit further comprises:

a third plate member;

wherein the second plate member is interposed between the first plate member and the third plate member, and is capable of being adjustably inserted into the third plate member.

10. The stand according to claim 9, wherein the second plate member is slidably movable in a lengthwise direction of the first plate member or the third plate member with respect to at least one of the first plate member and the third plate member.

11. The stand according to claim 10, further comprising a position settling unit which determines a fixed position of the second plate member with respect to at least one of the first plate member and the third plate member.

12. The stand of claim 9, wherein the first plate member and the third plate member have a same shape and are arranged symmetrically, such that the first plate member and the third plate member are interchangeable during assembly.

13. The stand according to claim 9, wherein the third plate member comprises:

a surface unit; and a bent unit bent in a bending direction, the bent unit starting from the surface unit and bending back toward the surface unit.

14. The stand according to claim 9, wherein the second plate member is capable of being inserted into each of the first plate member and the third plate member.

15. The stand of claim 1, wherein:

the first plate member comprises:

a first surface unit; and a first bent unit provided to at least one of opposite end parts of the first surface unit; and the second plate member comprises:

a second surface unit; and a second bent unit provided to at least one of opposite end parts of the second surface unit, the second bent unit being capable of being adjustably inserted into the first bent unit and attached thereto at the at least one of the opposite end parts of the first surface unit and the at least one of the opposite end parts of the second surface unit to enable the second plate member to be fixed to the first plate member according to the adjusted insertion.

16. The stand of claim 15, wherein each of the first and second bent units are formed of a plurality of bends along a bending direction.

17. The stand according to claim 15, wherein the second bent unit is integrally formed with and extends from the second surface unit and is bent in a bending direction, the second bent unit starting from the second surface unit and bending back toward the second surface unit.

18. The stand of claim 15, wherein at least one pair of the first surface unit and the first bent unit and the second surface unit and the second bent unit is integrally formed.

19. The stand of claim 15, wherein the first bent unit is integrally formed with and extends from the first surface unit and is bent in a bending direction, the first bent unit starting from the first surface unit and bending back toward the first surface unit.

20. The stand of claim 15, wherein the first surface unit forms an external surface of the stand.

21. The stand of claim 15, wherein:

the first bent unit provided to one end part of the first surface unit is bent in a first bending direction, and a third bent unit provided to the other end part of the first surface unit is bent in a second bending direction opposite to the first bending direction; and the second bent unit provided to one end part of the second surface unit is bent in the first bending direction, and a fourth bent unit provided to the other end part of the second surface unit is bent in the second bending direction.

22. The stand of claim 15, wherein the first and second bent units extend from the first and second surface units, respectively, to protrude in a same direction with respect to the first and second surface units.

23. The stand of claim 1, wherein the first plate member includes a guide protrusion and the second plate member includes a guide groove corresponding with the guide protrusion, to guide the second plate member being inserted into the first plate member.

24. The stand according to claim 1, wherein the upper plate unit and the lower plate unit have a same shape and are arranged symmetrically, such that the upper plate unit and the lower plate unit are interchangeable during assembly.

25. An image forming apparatus, comprising:

a printing engine to form an image on a printing medium; and a stand to support the printing engine, the stand comprising:

an upper plate unit comprising:

a first plate member including a first surface unit; and a second plate member including a second surface unit, the second plate member being capable of being adjustably inserted into the first plate member and attached thereto to define a first dimension of the stand, and at least one of the first plate member and the second plate member being adjustable to determine a second dimension of the stand different from the first dimension and corresponding to a height of the stand; and a lower plate unit capable of being slidably inserted into the upper plate unit, the second dimension of the stand being determined by a relative position of the upper plate unit and the lower plate unit.

* * * * *